US008187040B2

(12) United States Patent
Pepe et al.

(10) Patent No.: US 8,187,040 B2
(45) Date of Patent: May 29, 2012

(54) MOUNTING FEATURE FOR THE CONTACT ARRAY OF AN ELECTRICAL CONNECTOR

(75) Inventors: Paul John Pepe, Clemmons, NC (US); Steven Richard Bopp, Jamestown, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/685,347

(22) Filed: Jan. 11, 2010

(65) Prior Publication Data

US 2011/0171858 A1 Jul. 14, 2011

(51) Int. Cl.
*H01R 24/00* (2011.01)

(52) U.S. Cl. ..... 439/676

(58) Field of Classification Search ..... 439/676, 439/941, 620.11, 620.23
See application file for complete search history.

(56) References Cited

U.S. PATENT DOCUMENTS

| | | | | |
|---|---|---|---|---|
| 5,924,896 | A | 7/1999 | Arnett et al. | |
| 5,947,772 | A | 9/1999 | Arnett et al. | |
| 5,975,919 | A | 11/1999 | Arnett et al. | |
| 6,350,158 | B1 * | 2/2002 | Arnett et al. | 439/676 |
| 6,641,443 | B1 | 11/2003 | Itano et al. | |
| 7,238,060 | B1 | 7/2007 | Lee et al. | |
| 7,601,034 | B1 * | 10/2009 | Aekins et al. | 439/676 |
| 2002/0086586 | A1 | 7/2002 | Shi et al. | |
| 2004/0106329 | A1 | 6/2004 | Wang et al. | |
| 2006/0128228 | A1 * | 6/2006 | Wan et al. | 439/676 |
| 2007/0270043 | A1 * | 11/2007 | Pepe et al. | 439/676 |
| 2009/0023338 | A1 * | 1/2009 | He et al. | 439/607 |
| 2009/0042451 | A1 | 2/2009 | He et al. | |
| 2009/0203264 | A1 * | 8/2009 | Pepe et al. | 439/676 |

OTHER PUBLICATIONS

International Search Report for International Application No. PCT/US2011/000023 dated Mar. 25, 2011.

* cited by examiner

*Primary Examiner* — Jean F Duverne

(57) ABSTRACT

A contact sub-assembly is provided for an electrical connector. The contact sub-assembly includes a base having a mounting opening, and an array of mating contacts. Each mating contact includes a mating interface. A support block extends a length along a central longitudinal axis. Openings extend through the support block. The openings are spaced apart from one another along the length of the support block. The mating contacts extend through corresponding openings. A mounting post extends outwardly from the support block in a direction that is non-parallel to the central longitudinal axis of the support block. The mounting post is received within the mounting opening of the base.

23 Claims, 8 Drawing Sheets

MOUNTING FEATURE FOR THE CONTACT ARRAY OF AN ELECTRICAL CONNECTOR

BACKGROUND OF THE INVENTION

The subject matter described and/or illustrated herein relates generally to electrical connectors, and, more particularly, to electrical connectors that include contact sub-assemblies.

Electrical connectors that are commonly used in telecommunication systems provide an interface between successive runs of cables and/or between cables and electronic devices of the system. Some of such electrical connectors, for example modular jacks, are configured to be joined with a mating plug and include a contact sub-assembly having an array of mating contacts. Each of the mating contacts includes a mating interface that engages a corresponding contact of the mating plug to electrically connect the mating plug to the electrical connector.

The mating contacts are typically held in the array by one or more support blocks. The support block holds the mating contacts in the predetermined pattern of the array. Specifically, the support block includes a plurality of openings that are spaced apart along the length of the support block. Each of the mating contacts extends through a corresponding one of the openings. The spacing of the openings matches the predetermined pattern of the array and spaces the mating contacts apart from each other to prevent adjacent mating contacts from shorting. The array of mating contacts is mounted on a base of the contact sub-assembly. The base is held within a housing of the modular jack. The housing includes an opening that receives the mating plug therein. The base holds the array of mating contacts proximate the housing opening such that each of the mating contacts is positioned to engage the corresponding contact of the mating plug.

The support block is often used to mount the array of mating contacts on the base. For example, in one known method for mounting the array of mating contacts on the base using the support block, the base includes opposing notches that define ledges of the base. Opposite ends of the support block are received within corresponding ones of the notches and rest on the corresponding ledge to hold the support block, and thus the array of mating contacts, on the base. But, known methods for mounting the array of mating contacts on the base using the support block are not without disadvantages. For example, the connection between the support block and the base may be insufficient to hold the array of mating contacts on the base, such as, but not limited to, during mating and/or unmating of the mating plug and modular jack, during installation, and/or during shipping. Moreover, and for example, the connection between the support block and the base may not accurately align and/or position the mating contacts relative to the base, which may cause misalignment of the mating contacts relative to the corresponding contacts of the mating plug.

BRIEF DESCRIPTION OF THE INVENTION

In one embodiment, a contact sub-assembly is provided for an electrical connector. The contact sub-assembly includes a base having a mounting opening, and an array of mating contacts. Each mating contact includes a mating interface. A support block extends a length along a central longitudinal axis. Openings extend through the support block. The openings are spaced apart from one another along the length of the support block. The mating contacts extend through corresponding openings. A mounting post extends outwardly from the support block in a direction that is non-parallel to the central longitudinal axis of the support block. The mounting post is received within the mounting opening of the base.

In another embodiment, an electrical connector includes a housing and a contact sub-assembly held by the housing. The contact sub-assembly includes a base having a mounting opening, and an array of mating contacts. Each mating contact includes a mating interface. A support block extends a length along a central longitudinal axis. Openings extend through the support block. The openings are spaced apart from one another along the length of the support block. The mating contacts extend through corresponding openings. A mounting post extends outwardly from the support block in a direction that is non-parallel to the central longitudinal axis of the support block. The mounting post is received within the mounting opening of the base.

DETAILED DESCRIPTION OF THE INVENTION

Figure 1:
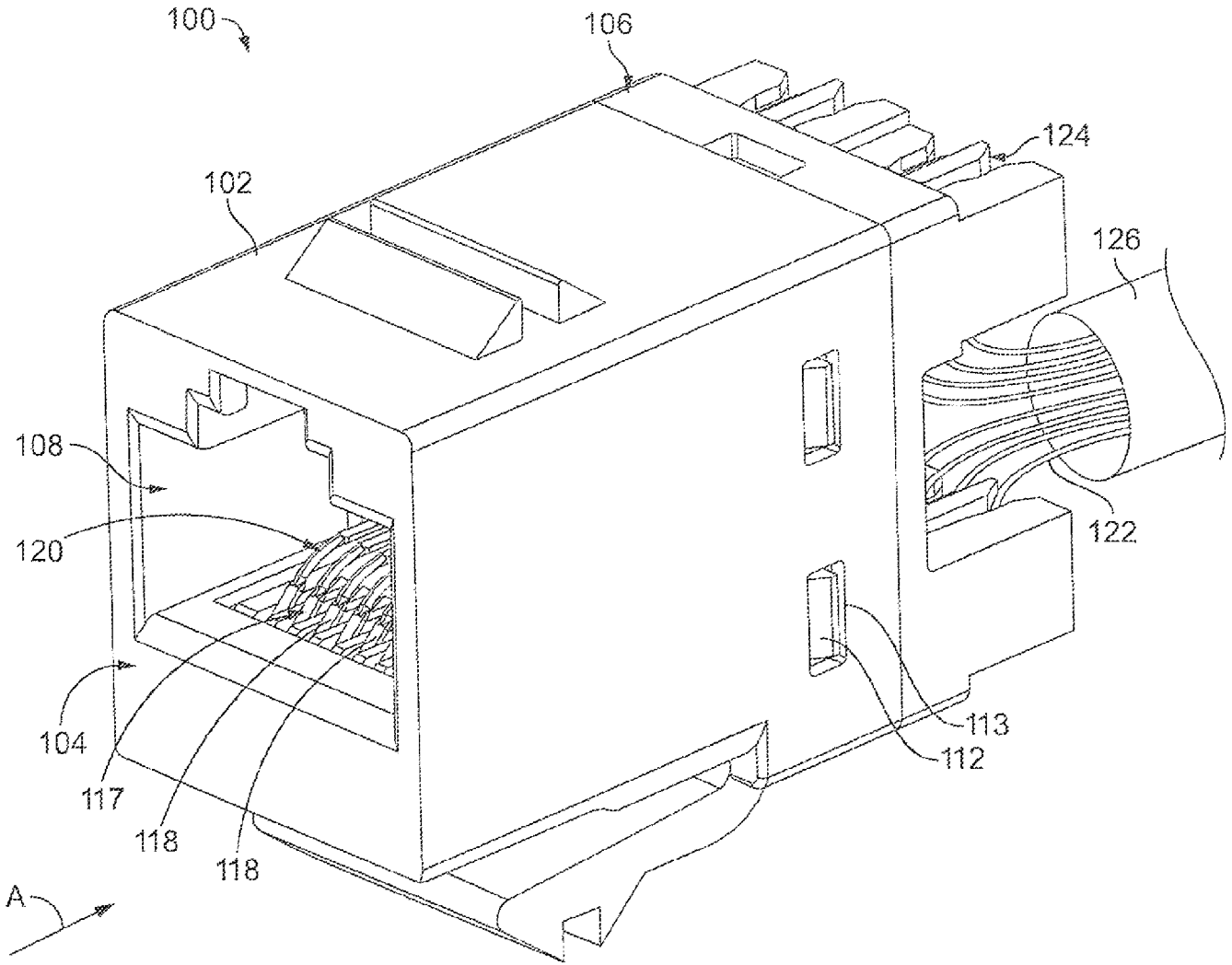
FIG. 1 is a perspective view of an exemplary embodiment of an electrical connector.

FIG. 1 is a perspective view of an exemplary embodiment of an electrical connector 100. In the exemplary embodiment, the connector 100 is a modular connector, such as, but not limited to, an RJ-45 outlet or jack. However, the subject matter described and/or illustrated herein is applicable to any other type of electrical connector. The connector 100 is configured for joining with a mating plug (not shown). The mating plug is loaded along a mating direction, shown generally by arrow A. The connector 100 includes a housing 102 extending from a mating end portion 104 to a terminating end portion 106. The housing 102 includes a cavity 108 that receives the mating plug therein through the mating end portion 104 of the housing 102.

Figure 2:
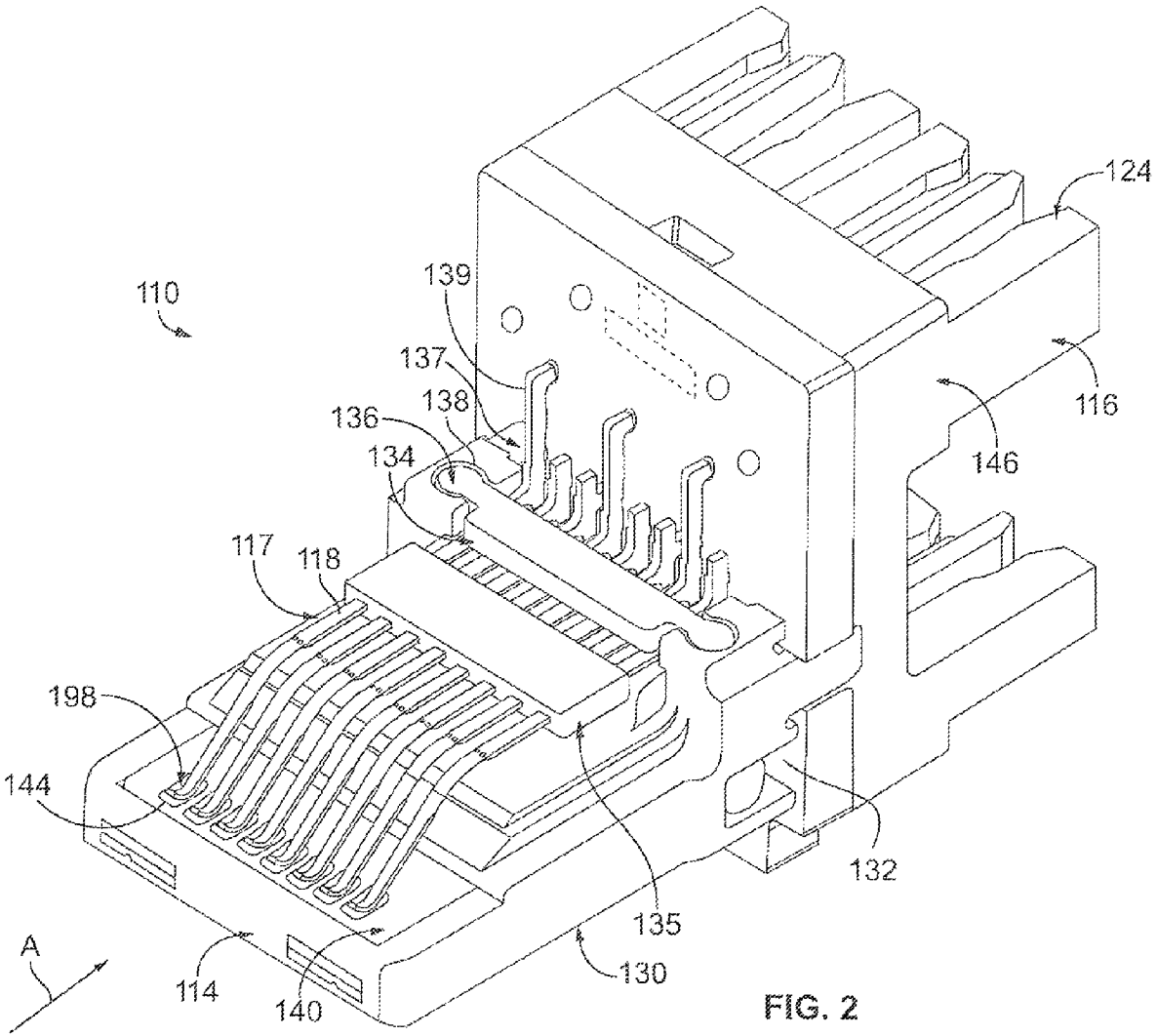
FIG. 2 is a perspective view of an exemplary embodiment of a contact sub-assembly of the electrical connector shown in FIG. 1.

The connector 100 includes a contact sub-assembly 110 (FIGS. 2 and 8) received within the housing 102 through the terminating end portion 106 of the housing 102. In the exemplary embodiment, the contact sub-assembly 110 is secured to the housing 102 via tabs 112 of the contact sub-assembly 110 that cooperate with corresponding openings 113 within the housing 102. The contact sub-assembly 110 extends from a mating end portion 114 (FIG. 2) to a terminating end portion 116 (FIG. 2). The contact sub-assembly 110 is held within the housing 102 such that the mating end portion 114 of the contact sub-assembly 110 is positioned proximate the mating end portion 104 of the housing 102. The terminating end portion 116 extends outward from the terminating end portion 106 of the housing 102. The contact sub-assembly 110 includes an array 117 of a plurality of mating contacts 118. Each mating contact 118 within the array 117 includes a mating interface 120 arranged within the cavity 108. Each mating interface 120 engages a corresponding contact (not shown) of the mating plug when the mating plug is mated with the connector 100. The arrangement of the mating contacts 118 may be controlled by industry standards, such as, but not limited to, International Electrotechnical Commission (IEC) 60603-7. In an exemplary embodiment, the connector 100 includes eight mating contacts 118 arranged as differential pairs. However, the connector 100 may include any number of mating contacts 118, whether or not the mating contacts 118 are arranged in differential pairs.

In the exemplary embodiment, a plurality of communication wires 122 are attached to terminating contacts 124 of the contact sub-assembly 110. The terminating contacts 124 are located at the terminating end portion 116 of the contact sub-assembly 110. Each terminating contact 124 is electrically connected to a corresponding one of the mating contacts 118. The wires 122 extend from a cable 126 and are terminated to the terminating contacts 124. Optionally, the terminating contacts 124 include insulation displacement connections (IDCs) for terminating the wires 122 to the contact sub-assembly 110. Alternatively, the wires 122 may be terminated to the contact sub-assembly 110 via any other type of connection, such as, but not limited to, a soldered connection, a press-fit connection (for example using compliant pins), and/or the like. In the exemplary embodiment, eight wires 122 arranged as differential pairs are terminated to the connector 100. However, any number of wires 122 may be terminated to the connector 100, whether or not the wires 122 are arranged in differential pairs. Each wire 122 is electrically connected to a corresponding one of the mating contacts 118 via the corresponding terminating contact 124, a printed circuit 132 (FIG. 2), and a corresponding circuit contact 139. Accordingly, the connector 100 provides electrical signal, electrical ground, and/or electrical power paths between the mating plug and the wires 122 via the mating contacts 118 and the terminating contacts 124.

FIG. 2 is a perspective view of an exemplary embodiment of the contact sub-assembly 110. The contact sub-assembly 110 includes a base 130 extending from the mating end portion 114 to the printed circuit 132. The base 130 holds the mating contact array 117 such that the mating contacts 118 extend in a direction that is generally parallel to the loading direction A of the mating plug (not shown). The mating contacts 118 are held within the array 117 by one or more support blocks 134 and/or 135. In the exemplary embodiment, the support block 134 is used to mount the mating contact array 117 on the base 130. As will be described in more detail below, the support block 134 includes one or more mounting posts 136 that are received within mounting openings 138 of the base 130 to hold the support block 134, and thus the mating contact array 117, on the base 130.

In the exemplary embodiment, the contact sub-assembly 110 includes an array 137 of a plurality of the circuit contacts 139. The circuit contacts 139 electrically connect the mating contacts 118 to the printed circuit 132. Each circuit contact 139 is optionally separably engaged with and electrically connected to a corresponding one of the mating contacts 118, such that each circuit contact 139 is discrete from the corresponding mating contact 118. As used herein, the term "discrete" is intended to mean constituting a separate part or component. Alternatively, one or more of the circuit contacts 139 is not discrete and separable from the corresponding mating contact 118, but rather is formed integrally with the corresponding mating contact 118.

The contact sub-assembly 110 also includes the terminating end portion 116, which includes a terminating portion body 146 extending from the printed circuit 132. The terminating portion body 146 includes the terminating contacts 124. The terminating portion body 146 is sized to substantially fill the rear portion of the housing cavity 108 (FIG. 1). Each terminating contact 124 is electrically connected to a corresponding mating contact 118 via the printed circuit 132 and a corresponding one of the circuit contacts 139.

Optionally, the contact sub-assembly 110 includes a printed circuit 140 that is received within an interior cavity 160 (FIG. 3) of the base 130. The printed circuit 140 includes a plurality of contact pads 144 that are electrically connected to the printed circuit 132 via corresponding traces (not shown) of the printed circuit 140, corresponding contacts (not shown) of the printed circuit 140, and/or and the circuit contacts 139. When mated with the corresponding contact (not shown) of the mating plug (not shown), a tip end portion 198 of each of the mating contacts 118 is engaged with and electrically connected to a corresponding one of the contact pads 144. The printed circuit 140 may provide a secondary path and/or crosstalk compensation for electrical signals, electrical power, and/or electrical grounds propagating through the contact sub-assembly 110.

Figure 3:
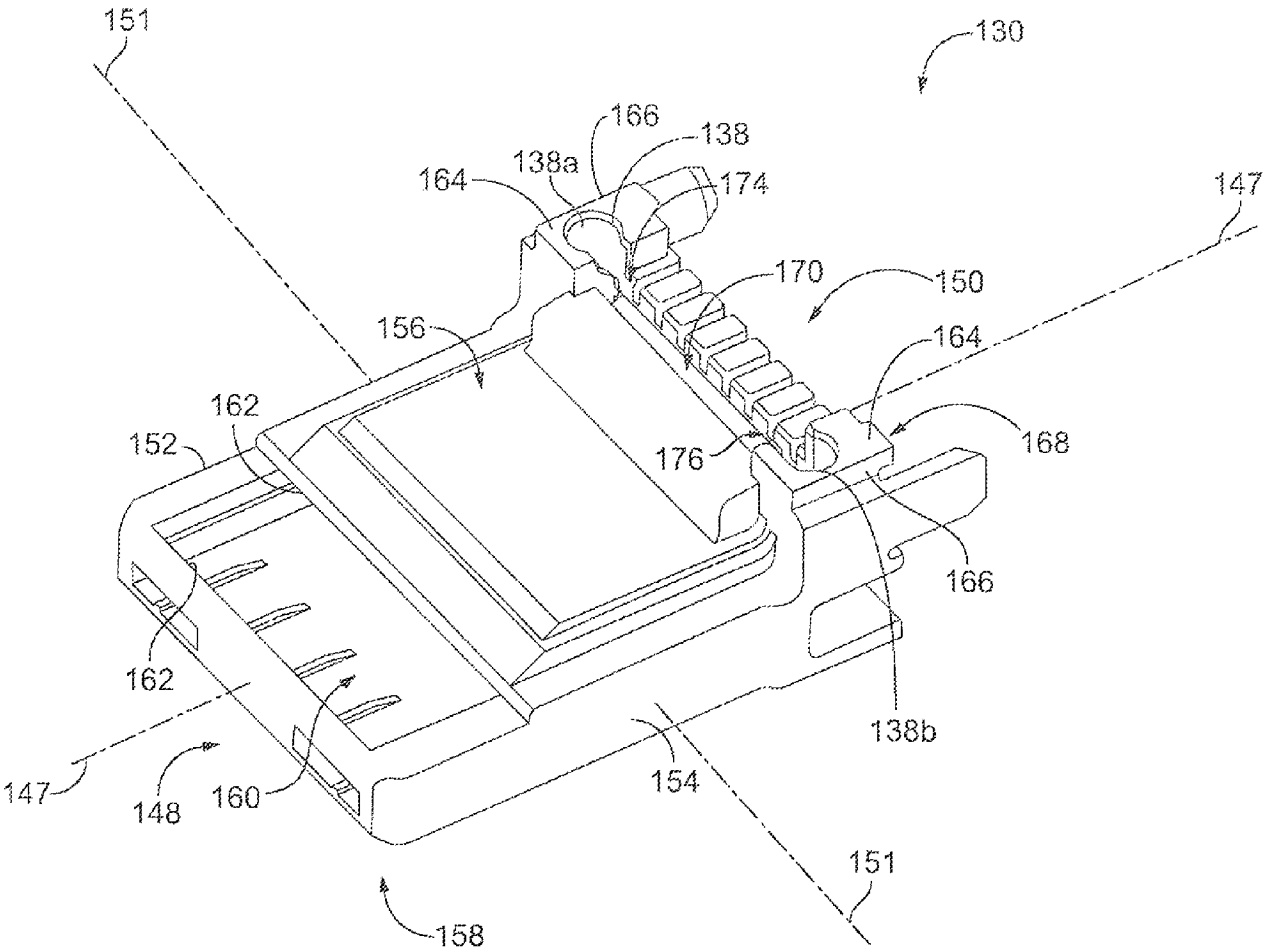
FIG. 3 is a perspective view of an exemplary embodiment of a base of the contact sub-assembly shown in FIG. 2.

FIG. 3 is a perspective view of an exemplary embodiment of the base 130. The base 130 extends a length along a central longitudinal axis 147 from an end 148 to an opposite end 150, and extends a width along an axis 151 from a side wall 152 to an opposite side wall 154. The base 130 includes an array side 156 and a bottom side 158 that is opposite the array side 156. The array side 156 defines a platform along which the mating contact array 117 (FIGS. 1, 2, and 6-8) extends. The interior cavity 160 extends within the base 130. The interior cavity 160 receives the printed circuit 140 (FIG. 2). An opening 162 extends through the array side 156 of the base 130 into the interior cavity 160. When the printed circuit 140 is received within the interior cavity 160 of the base 130, the opening 162 is configured to expose the contact pads 144 (FIG. 2) of the printed circuit 140. The opening 162 thereby enables the mating contacts 118 to engage the contact pads 44 when the printed circuit 140 is received within the interior cavity 160.

The array side 156 of the base 130 includes a pair of mounting ears 164. In the exemplary embodiment, the mounting ears 164 are each located along the length of the base 130 proximate the end 150, and are each located along the width of the base 130 proximate a corresponding one of the side walls 152 and 154. A side portion 166 of one or more of the mounting ears 164 optionally defines a portion of the corresponding side wall 152 and 154. Similarly, a rear portion 168 of one or more of the mounting ears 164 optionally defines a portion of the base end 150. Each mounting ear 164 includes one of the mounting openings 138. Specifically, at each of the mounting ears 164, a corresponding one of the mounting openings 138 extends into the array side 156 of the base 130. An optional channel 170 extends into the array side 156 between the side walls 152 and 154 of the base 130. The channel 170 is configured to receive an extension 172 (FIGS. 6-8) of the support block 134 therein, as will be described below. The channel 170 extends from an end 174 to an opposite end 176. In the exemplary embodiment, the channel 170 extends from one of the mounting openings **138*a* to the other mounting opening 138*b*, and the ends 174 and 176 of the channel 170 extend into the mounting openings 138*a* and 138*b*, respectively. In other words, the channel 170 intersects both of the mounting openings 138*a* and 138*b* and provides a continuous channel that extends from the mounting opening 138*a* to the mounting opening 138*b***.

Although two are shown, the base 130 may include any number of the mounting ears 164, each of which may include any number of the mounting openings 138. Each mounting ear 164 may be located at any other position along the length and along the width of the base 130 in addition or alternatively to the locations shown herein. Although the base 130 is shown herein as including two mounting openings 138, the base 130 may include any number of mounting openings 138 for receiving any number of mounting posts 136 (FIGS. 2 and 6-8). In some alternative embodiments, the channel 170 does not intersect the mounting opening 138*a* and/or the mounting opening 138*b*. Moreover, the channel 170 may extend within the base 130 along only a portion of the distance between the mounting openings 138. In some embodiments, the base 130 includes a plurality of channels 170 that are spaced apart from each other along the length and/or the width of the base 130. When extending along only a portion of the distance between the mounting openings 138, the channel 170 may extend at any location therebetween. Although shown as extending between the mounting openings 138*a* and 138*b*, the channel 170 may alternatively extend within the base 130 at a location that is not between the mounting openings 138*a* and 138*b*. In the exemplary embodiment, the channel 170 includes the general shape of a parallelepiped. But, in addition or alternative to the parallelepiped shape, the channel 170 may include any other shape for receiving an extension 172 including any shape.

Figure 4:
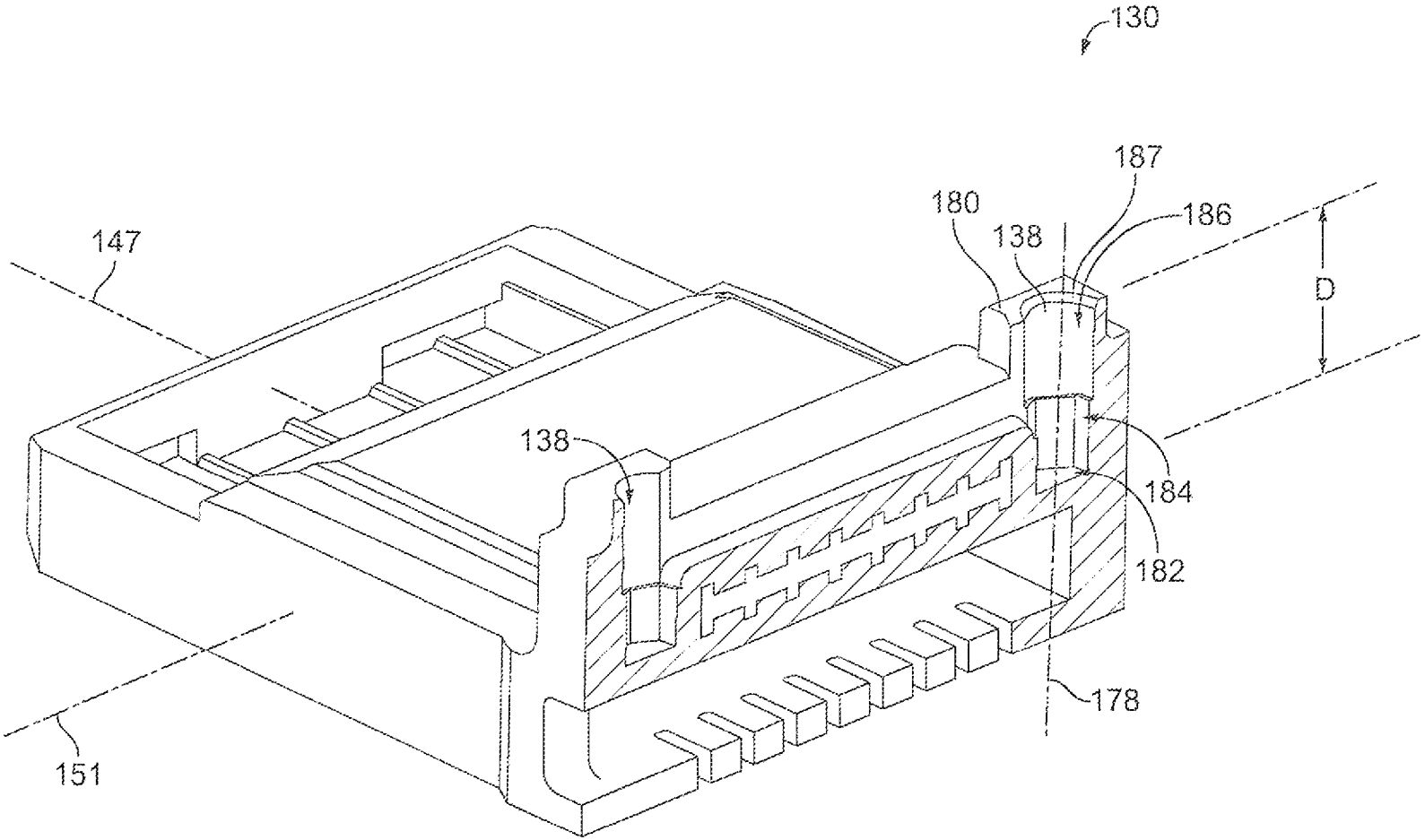
FIG. 4 is a perspective view of the base shown in FIG. 3 illustrating a cross section of the base.

FIG. 4 is a perspective view of the base 130 illustrating a cross section of the base 130 taken through the mounting openings 138 and the channel 170. Each of the mounting openings 138 extends into the base 130 along a central axis 178. Each mounting opening 138 extends a depth D along the central axis 178 from an upper surface 180 of the corresponding mounting ear 164 to a bottom wall 182. In the exemplary embodiment, the central axis 178 of each of the mounting openings 138 extends approximately perpendicular to each of the axes 147 and 151 of the base 130. However, the central axis 178 of each of the mounting openings 138 may extend at any other angle relative to the central longitudinal axis 147. Moreover, the central axis 178 of each of the mounting openings 138 may extend at any other angle relative to the axis 151.

Each of the mounting openings 138 includes a mount 184. As will be described below, the mount 184 engages the corresponding mounting post 136 (FIGS. 2 and 6-8) of the support block 134 to hold the mating contact array 117 (FIGS. 1, 2, and 6-8) on the base 130. In the exemplary embodiment, the mount 184 of each mounting opening 138 defines a bottom segment of the mounting opening 138. Specifically, each mounting opening 138 includes an upper segment 186 that extends along the depth D from the upper surface 180 of the corresponding mounting ear 164 to the mount 184. The mount 184 extends from the upper segment 186 to the bottom wall 182. Optionally, the intersection between the upper surface 180 and the upper segment 186 includes a chamfer 187. The chamfer 187 may be considered as a portion of the upper surface 180 or may be considered to be a portion of the upper segment 186 (and thus a portion of the depth D of the mounting opening 138). In the exemplary embodiment, the upper segment 186 includes a cylindrical shape. In addition or alternative to the cylindrical shape, the upper segment 186 may include any other shape.

The mount 184 of one or more of the mounting openings 138 may additionally or alternatively be located at any other location along the depth D of the mounting opening 138 than the bottom segment. For example, in some alternative embodiments, the mount 184 and the upper segment 186 are reversed, such that the mount 184 forms the upper segment of the mounting opening 138 and the upper segment 186 forms the bottom segment of the mounting opening 138. Another example of a differently located mount 184 is a mount 184 that forms an intermediate segment of the mounting opening 138 that extends between the upper segment 186 and a bottom segment of the mounting opening 138. Yet another example of a differently located mount 184 is a mount 184 that extends along an approximate entirety of the depth D of the corresponding mounting opening 138, wherein the approximate entirety of the depth D does not include the chamfer 187 (if the chamfer 187 is included).

Figure 5:
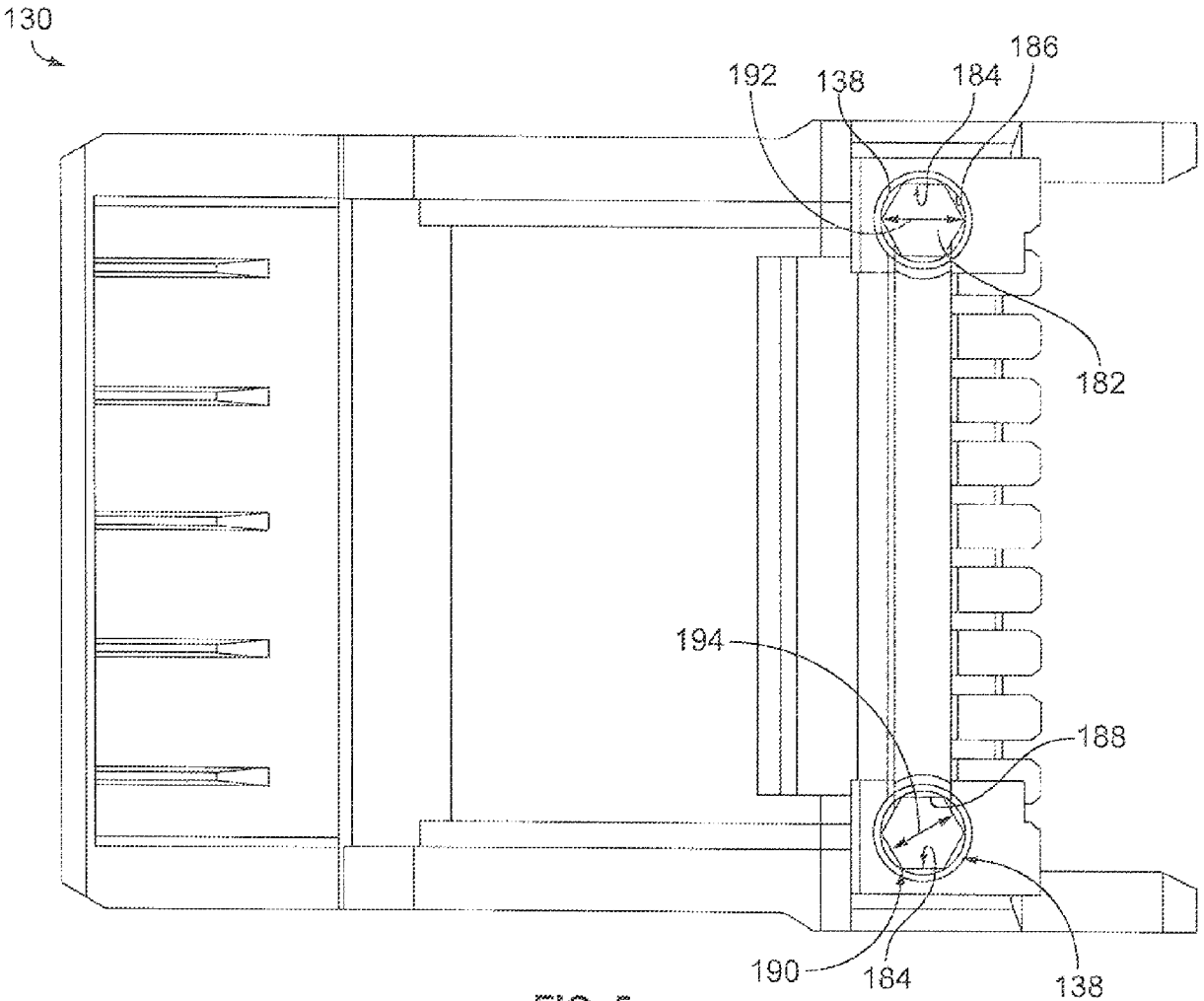
FIG. 5 is a plan view of the base shown in FIGS. 3 and 4.

FIG. 5 is a plan view of the base 130 illustrating an exemplary shape of the mounts 184 of the mounting openings 138. Each mounting opening 138 can be seen in FIG. 5 to include the upper segment 186, the mount 184, and the bottom wall 182. The exemplary mount 184 is configured to engage the corresponding mounting post 136 (FIGS. 2 and 6-8) in an interference fit. In the exemplary embodiment, the mount 184 includes a regular hexagonal cross-sectional shape. Specifically, the mount 184 includes six sides 188. Adjacent sides 188 intersect each other at vertices 190. Opposing vertices 190 define a diameter 192 of the mount 184. Opposing sides 188 define another diameter 194 of the mount 184 that is smaller than the diameter 192. As will be described below, the corresponding mounting post 136 engages the sides 188 in an interference fit to hold the mounting post 136 within the mounting opening 138.

Although the mount 184 of each mounting opening 138 is shown herein as having the regular hexagonal cross-sectional shape, each mount 184 may include any other cross-sectional shape for engagement with a mounting post 136 that includes any shape. For example, each mount 184 may include any other hexagonal cross-sectional shape besides the shape of a regular hexagon. Moreover, each mount 184 may include any other multi-sided cross-sectional shape. As used herein, the term "multi-sided" is intended to mean having two or more sides. Examples of other multi-sided cross-sectional shapes besides hexagonal include, but are not limited to, triangular, quadrilateral, rectangular, square, a pentagon, an octagon, a hexadecagon, a salinon, a lune, a Reuleaux polygon, a tomoe, a magatama, a heptagon, an astroid, a deltoid, a superellipse, a dodecagon, a decagon, and/or the like. Each mount 184 may include any single-sided shape, such as, but not limited to, a circle, a henagon, an ellipse, an oval, a semi-circle, and/or the like. Each mount 184 may be referred to herein as a "multi-sided mount" and/or as a "hexagonal mount".

Figure 6:
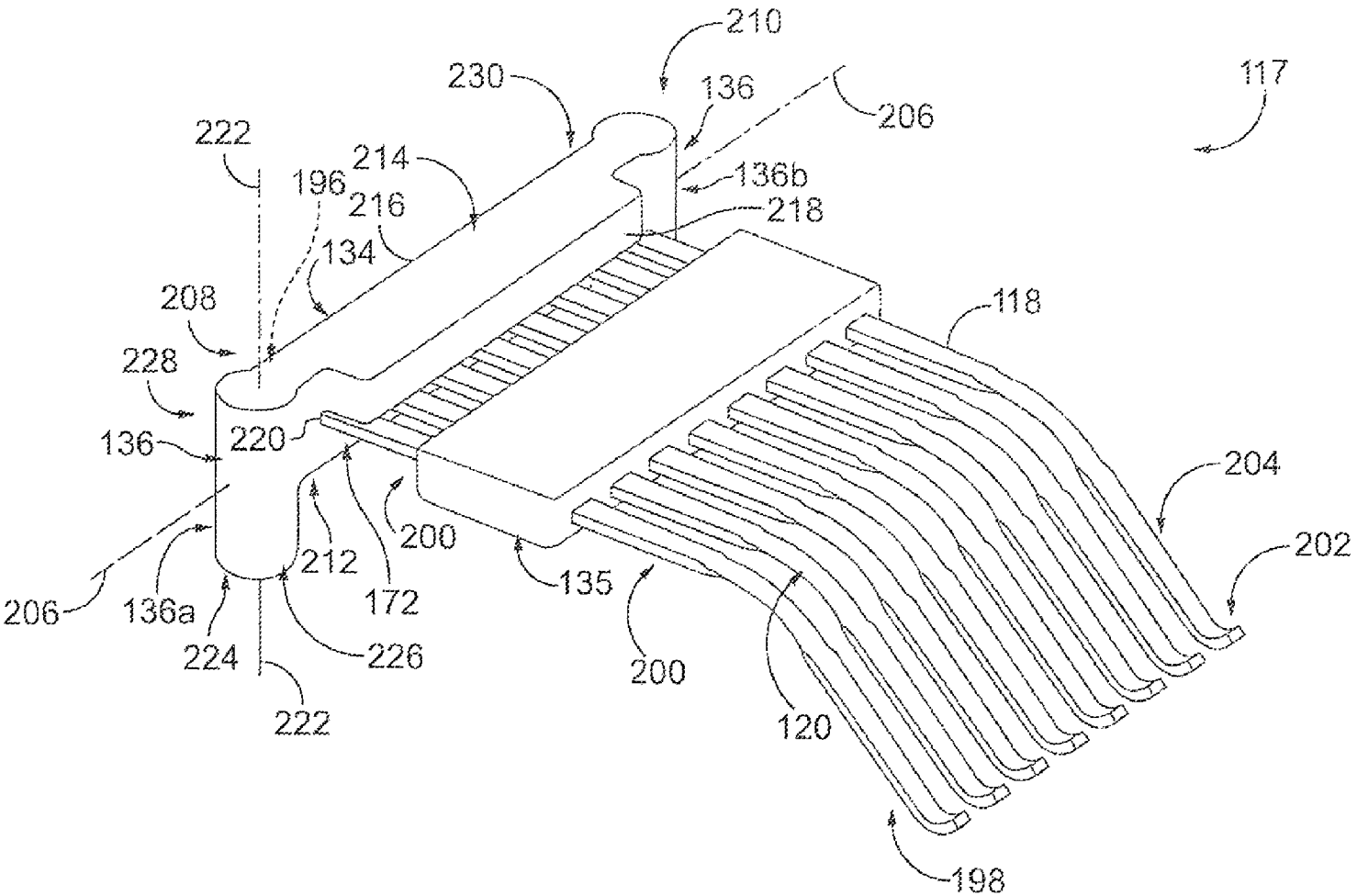
FIG. 6 is a perspective view of an exemplary embodiment of an array of mating contacts of the contact sub-assembly shown in FIG. 2.
Figure 7:
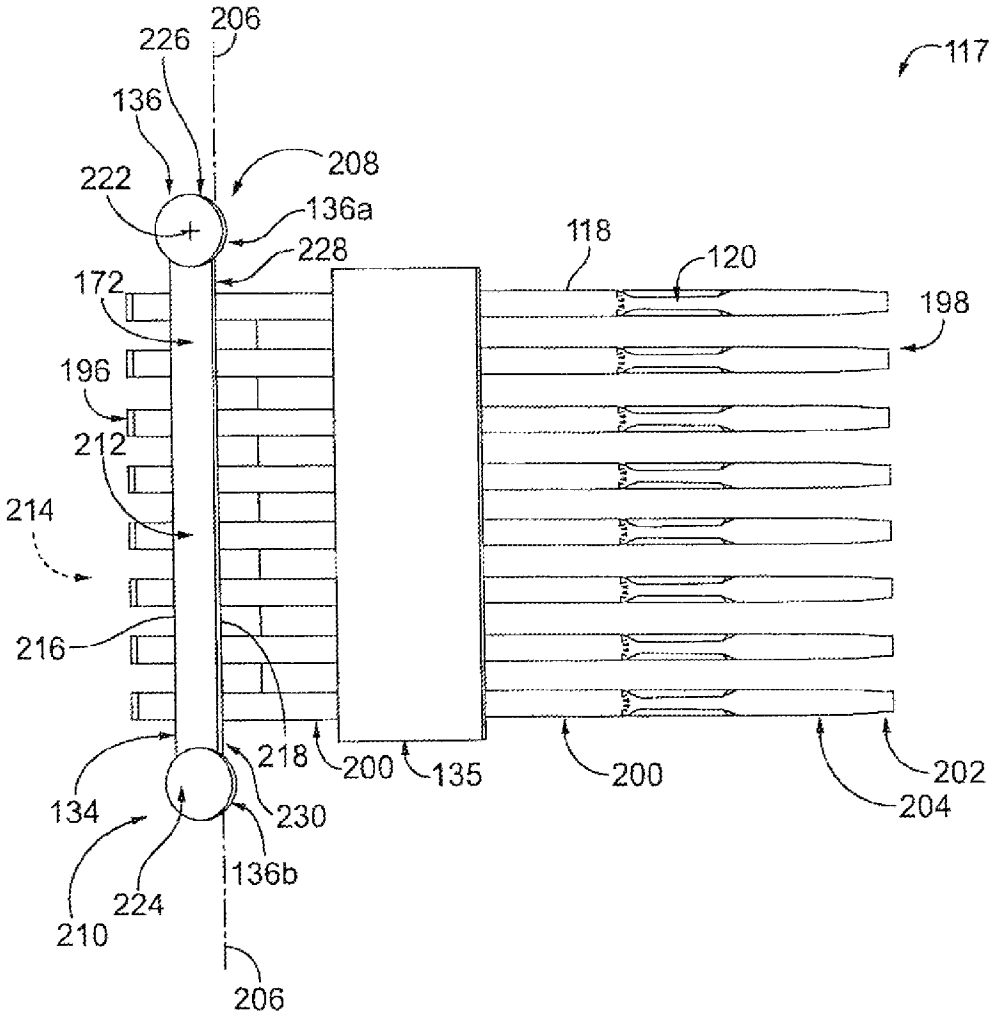
FIG. 7 is a plan view of the mating contact array shown in FIG. 6.

FIG. 6 is a perspective view of an exemplary embodiment of the array 117 of mating contacts 118. FIG. 7 is a plan view of the mating contact array 117. In the exemplary embodiment, the mating contact array 117 includes eight mating contacts 118 arranged as differential contact pairs. However, the mating contact array 117 may include any number of mating contacts 118, whether or not the mating contacts 118 are arranged in differential pairs. The mating contact array 117 includes the support blocks 134 and 135 that facilitate spacing each mating contact 118 apart from each adjacent mating contact 118 and/or facilitate aligning the mating interfaces 120 for engagement with the contacts (not shown) of the mating plug (not shown).

Each mating contact 118 extends a length from a terminating end portion 196 to the tip end portion 198. An intermediate portion 200 extends between the terminating end portion 196 and the tip end portion 198 of each mating contact 118. Each mating contact 118 includes the mating interface 120, which extends between the intermediate portion 200 and the tip end portion 198. Specifically, the intermediate portion 200 extends from the terminating end portion 196 to the mating interface 120, and the mating interface 120 extends from the intermediate portion 200 to the tip end portion 198. In the exemplary embodiment, the terminating end portion 196 of each mating contact 118 engages and electrically connects to a corresponding one of the circuit contacts 139 (FIG. 2). In the exemplary embodiment, the terminating end portions 196 of the mating contacts 118 are aligned within a common plane. Alternatively, the terminating end portion 196 of one or more of the mating contacts 118 is aligned within a different plane than the terminating end portion(s) 196 of one or more other mating contacts 118.

The intermediate portion 200 of each mating contact 118 extends from the terminating end portion 196 to the mating interface 120. Optionally, the intermediate portion 200 of one or more of the mating contacts 118 includes a cross-over section that crosses over or under the intermediate portion 200 of an adjacent mating contact 118. In the exemplary embodiment, the cross-over sections are covered by the support block 135 such that the cross-over sections are not visible herein. Any number of the mating contacts 118 within the contact array 117 may include a cross-over section. The mating interface 120 of each mating contact 118 extends from the intermediate portion 200 to the tip end portion 198. In the exemplary embodiment, the mating interface 120 is a curved portion. However, the mating interface 120 may have other shapes, such as, but not limited to, straight, angled, and/or the like. The tip end portion 198 of each mating contact 118 includes a tip 202 and a leg 204. The leg 204 extends from the mating interface 120 to the tip 202. The tip 202 extends outwardly from the leg 204. Optionally, the leg 204 of each mating contact 118 is angled relative to the intermediate portion 200, as can be seen in FIG. 6. In the exemplary embodiment, the tips 202 of each of the mating contacts 118 are aligned along a common plane. Alternatively, the tip 202 of one or ore of the mating contacts 118 is aligned within a different plane than the tip 202 of one or more other mating contacts 118.

The support block 134 extends a length along a central longitudinal axis 206 from an end 208 to an opposite end 210. The support block 134 includes a base side 212 and an upper side 214 that is opposite the base side 212. Opposite sides 216 and 218 each extend from the base side 212 to the upper side 214. A plurality of openings 220 extend through the support block 134. In the exemplary embodiment, the openings 220 extend through the sides 216 and 218 and completely through the support block 134 therebetween. The openings 220 are spaced apart from each other along the length, and thus along the central longitudinal axis 206, of the support block 134. As can be seen in FIGS. 6 and 7, each of the mating contacts 118 extends through a corresponding one of the openings 220. The support block 134 thus facilitates holding the mating contacts 118 in the exemplary predetermined pattern of the array 117, which may alternatively have any other pattern. Although the exemplary embodiment of the support block 134 includes eight openings 220, the support block 134 may include any number of the openings 220 for receiving any number of mating contacts 118 therethrough.

The mounting posts 136 extend outwardly from the base side 212 of the support block 134. In the exemplary embodiment, the support block 134 includes two mounting posts 136*a* and 136*b* that extend outwardly at a corresponding end 208 and 210 of the support block 134. But, each mounting post 136 may extend from any location along the length of the support block 134. Each mounting post 136 extends a length along a central longitudinal axis 222 to a post end 224. In the exemplary embodiment, the central longitudinal axis 222 of each of the mounting posts 136 extends approximately perpendicular to the central longitudinal axis 206 of the support block 134 and to the length of the mating contacts 118. However, the central longitudinal axis 222 of each of the mounting posts 136 may extend at any other angle relative to the central longitudinal axis 206. Moreover, the central longitudinal axis 222 of each of the mounting posts 136 may extend at any other angle relative to the length of the mating contacts 118. Although two are shown, the support block 134 may include any number of the mounting posts 136 for reception within any number of mounting openings 138.

Each of the mounting posts 136 includes a mount 226. The mount 226 engages the mount 184 (FIGS. 4, 5, and 8) of the corresponding mounting opening 138 (FIGS. 2-5 and 8) of the base 130. In the exemplary embodiment, the mount 226 of each mounting post 136 defines the post end 224 of the mounting post 136. In the exemplary embodiment, each mounting post 136 includes a cylindrical rod shape. In addition or alternative to the cylindrical rod shape, each mounting post 136 may include any other shape. The mount 226 of one or more of the mounting posts 136 may additionally or alternatively be located at any other location along the length of the mounting post 136 than the post end 224. As described above, the exemplary mount 226 is configured to engage the mount 184 of the corresponding mounting opening 138 in an interference fit. In the exemplary embodiment, the mount 226 includes a circular cross-sectional shape. But, each mount 226 may include any other cross-sectional shape for engagement with a mount 184 that includes any shape. The mount 184 may be referred to herein as a "cylindrical mount".

The support block 134 includes the extension 172. In the exemplary embodiment, the extension 172 extends outwardly from the base side 212 of the support block 134. The extension 172 is configured to be received within the channel 170 (FIGS. 3, 4, and 8) of the base 130. The extension 172 extends a length from an end 228 to an opposite end 230. In the exemplary embodiment, the extension 172 extends from one of the mounting posts 136*a* to the other mounting post 136*b*. In some alternative embodiments, the extension 172 does not intersect the mounting post 136*a* and/or the mounting post 136*b*. Moreover, the extension 172 may extend from the base side 212 of the support block 134 along only a portion of the distance between the mounting posts 136. In some embodiments, the support block 134 includes a plurality of extensions 172 that are spaced apart from each other along the length of the support block 134. When extending along only a portion of the distance between the mounting posts 136, the extension 172 may extend at any location therebetween. In the exemplary embodiment, the extension 172 includes the general shape of a parallelepiped. But, in addition or alternative to the parallelepiped shape, the extension 172 may include any other shape for reception within a channel 170 including any shape. Although only one is shown, the support block 134 may include any number of extensions 172.

Figure 8:
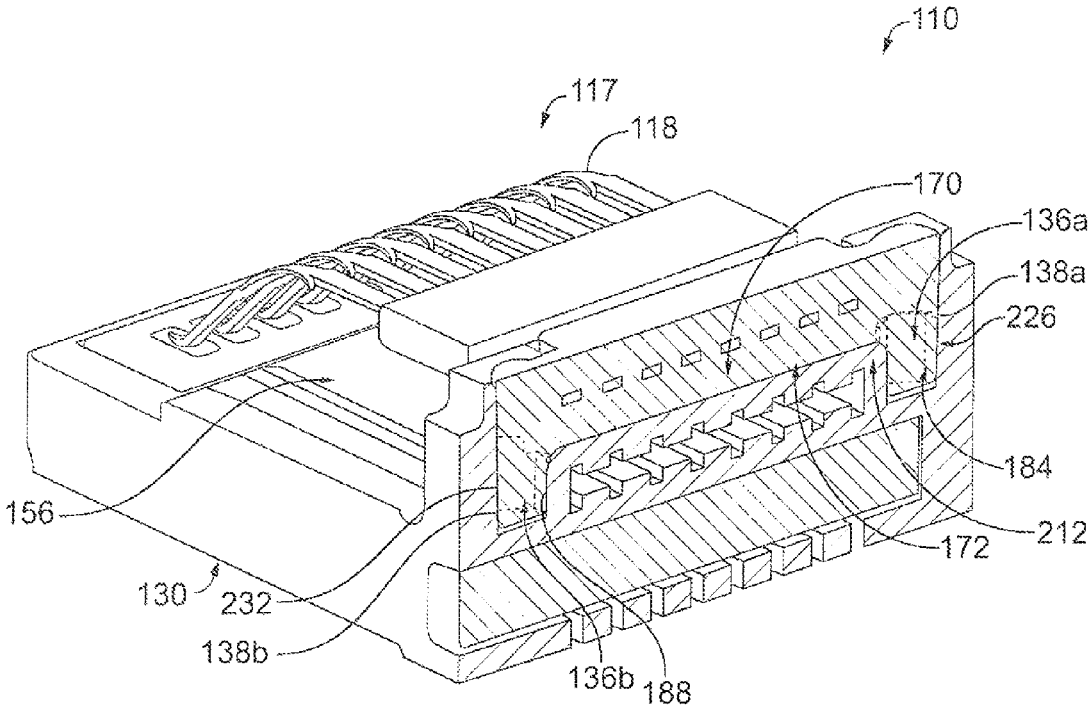
FIG. 8 is a perspective view of the contact sub-assembly shown in FIG. 2 illustrating a cross section of the contact sub-assembly.

FIG. 8 is a perspective view of the contact sub-assembly 110 illustrating a cross section of the contact sub-assembly 110. FIG. 8 illustrates the array 117 of mating contacts 118 mounted on the base 130. The mating contact array 117 extends along the array side 156 of the base 130 such that the base side 212 of the support block 134 faces the array side 156 of the base 130. To mount the mating contact array 117 on the base 130, the mounting posts 136*a* and 136*b* are received within the mounting openings 138*a* and 1386, respectively. The mounts 226 of the mounting posts 136*a* and 136*b* are engaged with the mounts 184 of the mounting openings 138*a* and 138*b*, respectively, in an interference fit. Specifically, an exterior surface 232 of each of the mounts 226 is engaged with the sides 188 of the corresponding mount 184 in an interference fit. The extension 172 of the support block 134 is received within the channel 170 of the base 130. Optionally, the extension 172 engages the base 130 within the channel 170 in an interference fit.

The relative size and shape between the mounts 184 of the mounting openings 138 and the mounts 226 of the mounting posts 136 may be selected to provide the interference fit therebetween. Alternatively, the mounts 226 and 184 of one or more of corresponding pairs of a mounting post 136 and a mounting opening 138, respectively, engage each other in a snap-fit. Although the exemplary mounts 226 and 184 shown herein include different shapes from each other, in some alternative embodiments, a mount 226 includes a substantially similar and/or the same shape as the corresponding mount 184. In other words, the interference fit between corresponding mounts 184 and 226 may be provided by substantially similar and/or the same shapes.

As used herein, the term "printed circuit" is intended to mean any electric circuit in which the conducting connections have been printed or otherwise deposited in predetermined patterns on a dielectric substrate.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A contact sub-assembly for an electrical connector, said contact sub-assembly comprising:

a base comprising a mounting opening, wherein the mounting opening comprises a multi-sided shape that defines a bottom segment of the mounting opening;

an array of mating contacts, each mating contact comprising a mating interface;

a support block extending a length along a central longitudinal axis, openings extending through the support block, the openings being spaced apart from one another along the length of the support block, the mating contacts extending through corresponding openings; and a mounting post extending outwardly from the support block in a direction that is non-parallel to the central longitudinal axis of the support block, the mounting post extending outwardly from the support block to a post end, the mounting post being received within the mounting opening of the base, the post end of the mounting post being engaged with the multi-sided shape of the mounting opening.

2. The contact sub-assembly according to claim 1, wherein the mounting post engages the base in an interference fit within the mounting opening.

3. The contact sub-assembly according to claim 1, wherein the mounting post extends approximately perpendicular to the central longitudinal axis of the support block.

4. The contact sub-assembly according to claim 1, wherein the base comprises a channel extending from the mounting opening, wherein an extension extends outwardly from the support block between the ends of the support block, the extension extending from the mounting post and being received within the channel.

5. The contact sub-assembly according to claim 1, wherein the base comprises an array side along which the array of mating contacts extends, the array side extending a width from a side wall to an opposite side wall, the base comprising a channel extending into the array side between the side walls, the support block comprising a base side that faces the array side of the base, wherein an extension extends outwardly from the base side of the support block between the ends of the support block, the extension being received within the channel.

6. The contact sub-assembly according to claim 1, wherein the base comprises an array side along which the mating interfaces of the mating contacts extend, the mounting opening extending into the base through the array side, the support block comprising a base side that faces the array side of the base, the mounting post extending outwardly from the base side of the support block.

7. The contact sub-assembly according to claim 1, wherein the mounting post comprises a cylindrical rod.

8. The contact sub-assembly according to claim 1, wherein the base comprises an array side along which the mating interfaces of the mating contacts extend, the support block comprising a base side that faces the array side of the base, wherein the mounting post extends outwardly from the support block past the base side of the support block.

9. The contact sub-assembly according to claim 1, further comprising a printed circuit mounted to the base.

10. The contact sub-assembly according to claim 9, wherein the base comprises an interior cavity, the printed circuit being mounted to the base such that the printed circuit is received within the interior cavity of the base.

11. An electrical connector comprising:

a housing; and a contact sub-assembly held by the housing, the contact sub-assembly comprising:

a base comprising a mounting opening comprising a multi-sided shape;

an array of mating contacts, each mating contact comprising a mating interface;

a support block extending a length along a central longitudinal axis, openings extending through the support block, the openings being spaced apart from one another along the length of the support block, the mating contacts extending through corresponding openings; and a mounting post extending outwardly from the support block in a direction that is non-parallel to the central longitudinal axis of the support block, the mounting post comprising a cylindrical shape, the mounting post being received within the mounting opening of the base, the cylindrical shape of the mounting post being engaged with the multi-sided shave of the mounting opening.

12. The electrical connector according to claim 11, wherein the mounting post engages the base in an interference fit within the mounting opening.

13. The electrical connector according to claim 11, wherein the mounting post comprises a cylindrical shape and the mounting opening comprises a hexagonal shape, the cylindrical shape of the mounting post being received within the hexagonal shape of the mounting opening in an interference fit.

14. The electrical connector according to claim 11, wherein the mounting post extends approximately perpendicular to the central longitudinal axis of the support block.

15. The electrical connector according to claim 11, wherein the base comprises a channel extending from the mounting opening, wherein an extension extends outwardly from the support block between the ends of the support block, the extension extending from the mounting post and being received within the channel.

16. The electrical connector according to claim 11, wherein the base comprises an array side along which the array of mating contacts extends, the array side extending a width from a side wall to an opposite side wall, the base comprising a channel extending into the array side between the side walls, the support block comprising a base side that faces the array side of the base, wherein an extension extends outwardly from the base side of the support block between the ends of the support block, the extension being received within the channel.

17. The electrical connector according to claim 11, wherein the base comprises an array side, the array of mating contacts being held by the base such that a length of the mating interface of at least one of the mating contacts extends along the array side of the base, the mounting opening extending into the base through the array side, the support block comprising a base side that faces the array side of the base, the mounting post extending outwardly from the base side of the support block.

18. A contact sub-assembly for an electrical connector, said contact sub-assembly comprising:

a base comprising a mounting opening having a multi-sided shape;

an array of mating contacts, each mating contact comprising a mating interface;

a support block extending a length along a central longitudinal axis, openings extending through the support block, the openings being spaced apart from one another along the length of the support block, the mating contacts extending through corresponding openings; and a mounting post extending outwardly from the support block in a direction that is non-parallel to the central longitudinal axis of the support block, the mounting post comprising a cylindrical shape, wherein the mounting post is received within the mounting opening of the base such that the cylindrical shape of the mounting post is engaged with the multi-sided shape of the mounting opening.

19. The contact sub-assembly according to claim 18, wherein the mounting opening comprises a hexagonal shape, the cylindrical shape of the mounting post being received within the hexagonal shape of the mounting opening in an interference fit.

20. The contact sub-assembly according to claim 18, wherein the multi-sided shape of the mounting opening defines a bottom segment of the mounting opening, the mounting post extending outwardly from the support block to a post end, the post end of the mounting post being engaged with the multi-sided shape of the mounting opening.

21. The contact sub-assembly according to claim 18, wherein the base comprises a channel extending from the mounting opening, wherein an extension extends outwardly from the support block between the ends of the support block, the extension extending from the mounting post and being received within the channel.

22. The contact sub-assembly according to claim 18, wherein the base comprises an array side along which the array of mating contacts extends, the support block comprising a base side that faces the array side of the base, wherein the mounting post extends outwardly from the support block past the base side of the support block.

23. The contact sub-assembly according to claim 18, further comprising a printed circuit engaged with the base, wherein the base extends a length from a mating end portion to the printed circuit.

* * * * *